US006614362B2

(12) United States Patent
Siegel

(10) Patent No.: US 6,614,362 B2
(45) Date of Patent: Sep. 2, 2003

(54) EMERGENCY VEHICLE ALERT SYSTEM

(76) Inventor: Michael A Siegel, 1390 Kelton Ave., Los Angeles, CA (US) 90024

( * ) Notice: Subject to any disclaimer, the term of this patent is extended or adjusted under 35 U.S.C. 154(b) by 164 days.

(21) Appl. No.: 09/883,452

(22) Filed: Jun. 18, 2001

(65) Prior Publication Data

US 2003/0043056 A1 Mar. 6, 2003

(51) Int. Cl.[7] ..... G08G 1/00
(52) U.S. Cl. ..... 340/902; 340/903
(58) Field of Search ..... 340/902, 901, 340/903, 904, 436, 539, 988, 989; 701/301–2

(56) References Cited

U.S. PATENT DOCUMENTS 5,235,329 A 8/1993 Jackson ..... 340/902
5,307,060 A * 4/1994 Prevulsky et al. ..... 340/902
5,926,112 A 7/1999 Hartzell ..... 340/902
6,087,961 A * 7/2000 Markow ..... 340/902
6,160,493 A * 12/2000 Smith ..... 340/902
6,175,329 B1 1/2001 Leandra ..... 342/357.09
6,326,903 B1 * 12/2001 Gross et al. ..... 340/988

* cited by examiner

*Primary Examiner*—Jeffery Hofsass
*Assistant Examiner*—Davetta W. Goins
(74) *Attorney, Agent, or Firm*—James E. Bame

(57) ABSTRACT

A method for an emergency vehicle alert system for transmitting signals from one or more emergency vehicles to a nearby commuter vehicle includes activating an initiation switch in one or more of the emergency vehicles. A transmitter located in each of the emergency vehicles, transmits a uniquely individual signal stamp of a predefined frequency and a GPS signal. Each emergency vehicle can be identified by the uniquely individual signal stamp. Other emergency vehicles and commuter vehicles in the area with the appropriate receiver can detect the transmitted signal stamp.

16 Claims, 4 Drawing Sheets

EMERGENCY VEHICLE ALERT SYSTEM

BACKGROUND

The field of invention relates to the transmission of signals for emergency vehicles. More specifically, this present invention relates to an improved method for transmitting signals from an emergency vehicle to nearby commuter vehicles.

Various methods and devices have been used to transmit a signal or warning from an emergency vehicle to nearby vehicles. Sirens are the most common that we all experience. While driving all of us, frequently hear the siren blast of a fire truck or ambulance. Another method involves sending a signal from the emergency vehicle to the traffic light at an upcoming intersection. The traffic light is programmed to turn red in all directions, when the traffic light receives the signal.

Sirens have several disadvantages. The volume of the siren limits the distance at which the siren can be heard. Excessive volume can be damaging to the ears of commuters, pedestrians, and the occupants of the emergency vehicle. Sirens have an additional disadvantage, because the commuter has difficulty discerning how many emergency vehicles are in the area or knowing from which direction they are approaching. One emergency vehicle sounding a siren can pass by the commuter vehicle. The commuter may erroneously assume that this is the only emergency vehicle travelling in the vicinity, thus the commuter vehicle resumes travel on the road. A second emergency vehicle then approaches with the travel path of the second emergency vehicle blocked by the commuter.

Sending a signal from the emergency vehicle to a traffic light, also has disadvantages. The emergency vehicle transmits a signal to the traffic light at an upcoming intersection. The traffic light responds by turning the traffic signal light red in all directions. Commuter traffic is halted, allowing the emergency vehicle to pass easily through the intersection. The cost of retrofitting all of the traffic signals in a city is borne by the city government. The costs can be prohibitive thus most cities decline to use the method.

Installing the transmitter device on each emergency vehicle is only a small portion of the cost. Each traffic light must have a receiver installed. Installing the receiver on new traffic lights can be expensive. The costs are even more prohibitive when the existing traffic lights need to be retrofitted with a receiver. Coordinating the halting of traffic during the installation can be very time consuming and disruptive to commuters. Retrofitting existing traffic signal systems is seldom accomplished, because of the expense and coordination required for implementing this system.

An effective emergency vehicle alert system is very important. Many lives are lost each year in vehicle accidents involving emergency vehicles. A speeding emergency vehicle traveling to treat an injury, is just another accident waiting to happen. Methods and systems are needed that will minimize the risk of the emergency vehicle incurring a collision with a commuter vehicle, which results in injury or death. An emergency vehicle alert system that transmitted a signal further than the hearing range of a siren, would allow commuter vehicles to pull to the side of the road sooner. The roads would be less obstructed and the emergency vehicle could travel faster, reaching the accident scene sooner. More lives would be saved, if the injuries and heart attacks were treated sooner.

Today, vehicles are constructed with a much quieter interior, than in past years. The quiet vehicles make it harder to hear outside noises, including the blare of a siren. More people live in urban cities and fewer people reside in sparsely traveled rural areas. The cities are densely populated and noisy, which hinders the ability of drivers to adequately hear and discern the siren, above the loud background noises. Additionally, cities have large, tall buildings that block the transmission of the siren sound. The siren sound tends to be funneled down the street. The siren sound does not effectively go around corners. Sound waves can bounce off of buildings and travel around corners to a certain limit, but sound waves do have a tendency to continue travel in the preexisting unobstructed direction.

Global positioning Systems (GPS) are commonly used for indicating the geographic position of your own vehicle. The GPS provides a reference from satellites, which allows the system to accurately show the location of your vehicle. To date, the GPS has not been effectively incorporated into an emergency vehicle alert system.

Therefore, there is a need for an emergency vehicle alert system that will transmit a signal farther than the hearing range of a siren. Furthermore, there is a need for a system, where all of the cost is not absorbed by the municipality. Additionally the emergency vehicle alert system should provide an indication when more than one emergency vehicle is present in the vicinity. Also the system should provide an indication of the relative position of the commuter vehicle in relation to the emergency vehicle.

SUMMARY

The emergency vehicle alert system (EVAS) fulfills the objective of transmitting a signal farther than the hearing range of a siren. The signal can be sent using one of many commonly available communication frequencies. Communication frequencies can transmit for many miles, in contrast to siren sounds that are limited in transmission range. Amplifiers can be used in the most densely congested downtown areas, where tall building may hinder the communication frequencies.

An additional advantage of the emergency vehicle alert system is distributing the system costs to commuter vehicle drivers, in addition to the municipal governments. The receiver is located in the commuter vehicle. The receiver can be original equipment from the factory on new cars. Existing commuter vehicles can be retrofitted with a receiver purchased from a local auto parts store. Also, local governments may coordinate reduced cost quantity purchases for the local citizens.

A method for an emergency vehicle alert system for transmitting signals from one or more emergency first vehicle to a nearby commuter second vehicle, comprises the following steps. Activating an initiation switch in one or more of the emergency first vehicles. Transmitting a uniquely individual signal stamp of a predefined redefined frequency from a transmitter in each of the emergency first vehicles. Receiving each of the predefined frequency signal stamps by a receiver in the commuter second vehicle. Actuating by the receiver of a notification warning, for observation by an occupant in the commuter second vehicle. Indicating by the receiver the number of emergency first vehicles in the vicinity, based on the uniquely individual signal of each emergency first vehicle. Counting down by the receiver the number of emergency first vehicles in the vicinity, as the emergency first vehicles travel beyond the transmitting range of each of the transmitters. Indicating an all-clear notification, when all emergency first vehicles have traveled beyond the transmitting range of each of the transmitters.

A GPS signal component can be included, in addition to the unique signal stamp of each emergency vehicle. The GPS signal includes the following steps. Transmitting a GPS signal of a predefined frequency from the emergency first vehicle, upon transmitting the uniquely individual signal stamp. Receiving the GPS signal of the predefined frequency signal by the receiver in the commuter second vehicle. Indicating within the commuter second vehicle the position of the emergency first vehicle in relation to the commuter second vehicle based on the GPS signal. Updating continuously the position of the emergency first vehicle in relation to the commuter second vehicle based on the GPS signal, such that the occupant can perform appropriate actions to avoid the emergency first vehicle.

A first sensor can be included to monitor the speed of the emergency vehicle. The EVAS includes the steps of sensing by a first sensor, and registering by a first sensor data on the speed and direction of the emergency first vehicle, upon transmitting a GPS signal. The first sensor sends the data to the transmitter. The transmitter has an algorithm that calculates the strength and approximate transmission distance of the signal, based on the speed of the emergency first vehicle. Emitting from the transmitter a forward biased signal stamp having a substantially 180 degrees eliptical shaped transmission area, upon transmitting of the signal stamp and GPS signal. The forward biased signal can be used for both the signal stamp and GPS signal.

The notification warning can be a voice recording, which is selected from a plurality of digitized voice recordings. Any one of the digitized voice recordings can be selected based on a user's preference. The receiver and the transmitter can include a microprocessor circuit. A radio frequency signal is effective over short distances, including less than 500 feet.

Initially a local government body can elect to install the transmitter on their emergency vehicles. Alternately, State or National regulations may be implemented that mandate the installation of the EVAS on emergency vehicles and commuter vehicles. Local governments can coordinate the sale and distribution of the receivers to the local populace. Rebates or discounts on the cost of the receiver devices can be offered by the local government. The notices, advertising, and reduced cost purchases facilitated by the local governments will encourage prompt and extensive implementation of the EVAS program by the local populace.

Area service stations can be authorized by the local government to provide reliable and inexpensive installation of the EVAS receiver on commuter vehicles. This authorizing of area service stations is similar to the program already in place for smog control certifications inspections. The EVAS receiver would be purchased in large quantities by the local government. The receivers would then be resold and distributed to the local service stations or direct to the populace.

Citizens could be prompted to make the purchase of the EVAS receiver, just as they are required to have smog certification checks. Additionally, the citizens will recognize the value of having a warning alert within their vehicles that will provide notice of a nearby emergency vehicle. Many people have experienced, hearing the siren of an ambulance moments before the ambulance appears in sight. Often, there is not enough time to calmly pull to the side of the road, with the short warning time. The EVAS can provide advanced warning of an approaching emergency vehicle. Sufficient advance warning to allow for a calm and safe movement to the side of the road.

Commuter vehicle drivers will clear the roads sooner and more completely. The emergency vehicles can maintain higher speeds while traveling to the scene of an accident or injury, thus arriving in less time. Victim's lives will be saved by sooner treatment. Fewer accidents will occur between emergency vehicles and commuter vehicles.

The EVAS can be uniform in the transmission frequency, so that a commuter vehicle can drive anywhere in the United States and the receiver will operate from the transmitter signal of all emergency vehicles in any local. Also, uniformity can reduce the overall cost of implementing the program, as design and manufacturing costs will be reduced by the mass quantity production of similar devices. The effectiveness and safety benefits of the EVAS are significantly enhanced by a nationwide implementation of a uniform system. A single transmission frequency can be authorized for the EVAS system. A dedicated transmission frequency is important to minimize or eliminate erroneous activation of the receivers in the commuter vehicles.

Although the present invention is briefly summarized, the fuller understanding of the invention is obtained by the following drawings, detailed description, and appended claims.

BRIEF DESCRIPTION OF THE DRAWINGS

These and other aspects, features and advantages of the present invention will become better understood with reference to the accompanying drawing, wherein.

DETAILED DESCRIPTION OF THE PREFERRED EMBODIMENTS

Figure 1:
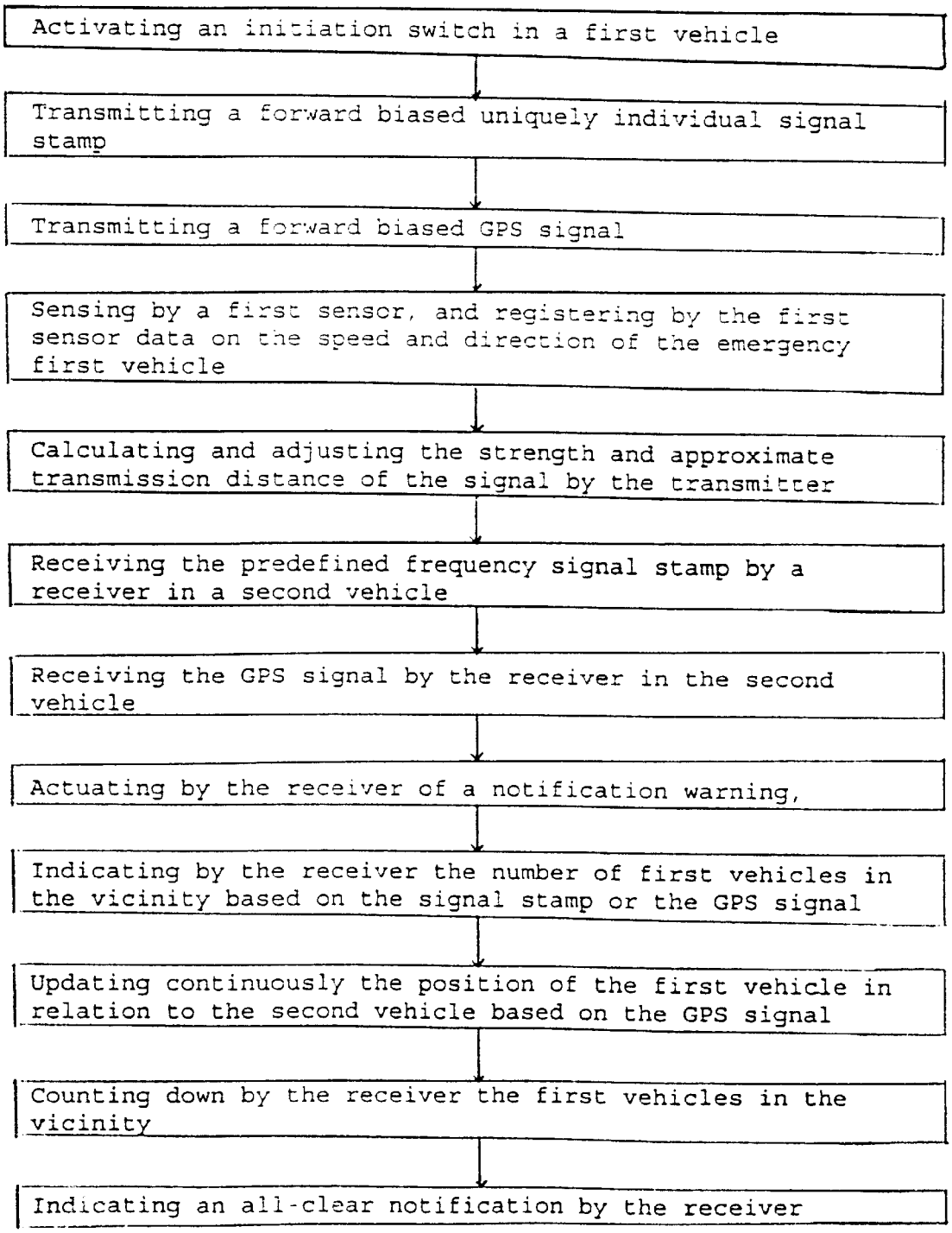
FIG. 1 shows the steps of the emergency vehicle alert system.
Figure 2:
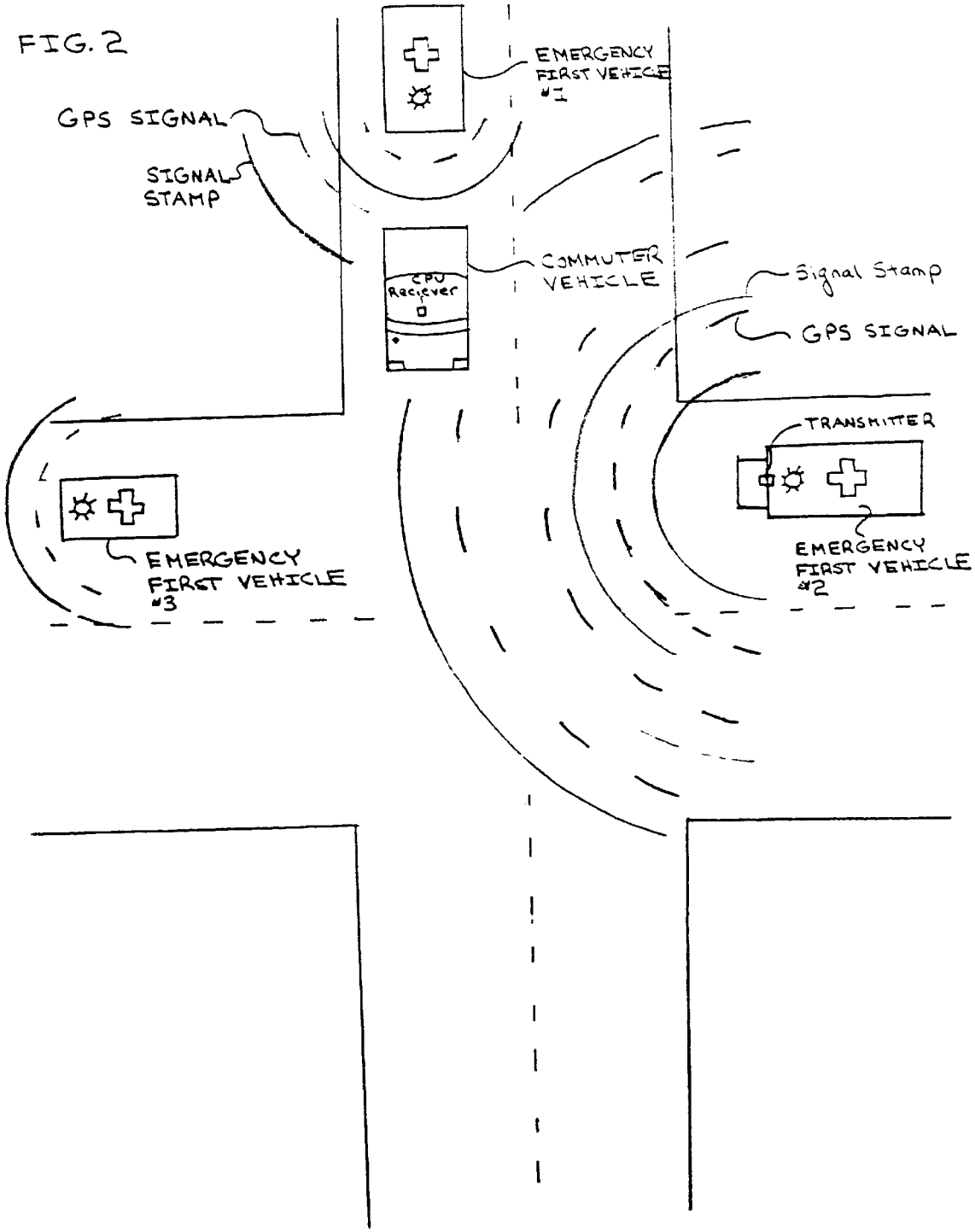
FIG. 2 shows a top view of a commuter vehicle and three emergency vehicles.
Figure 3:
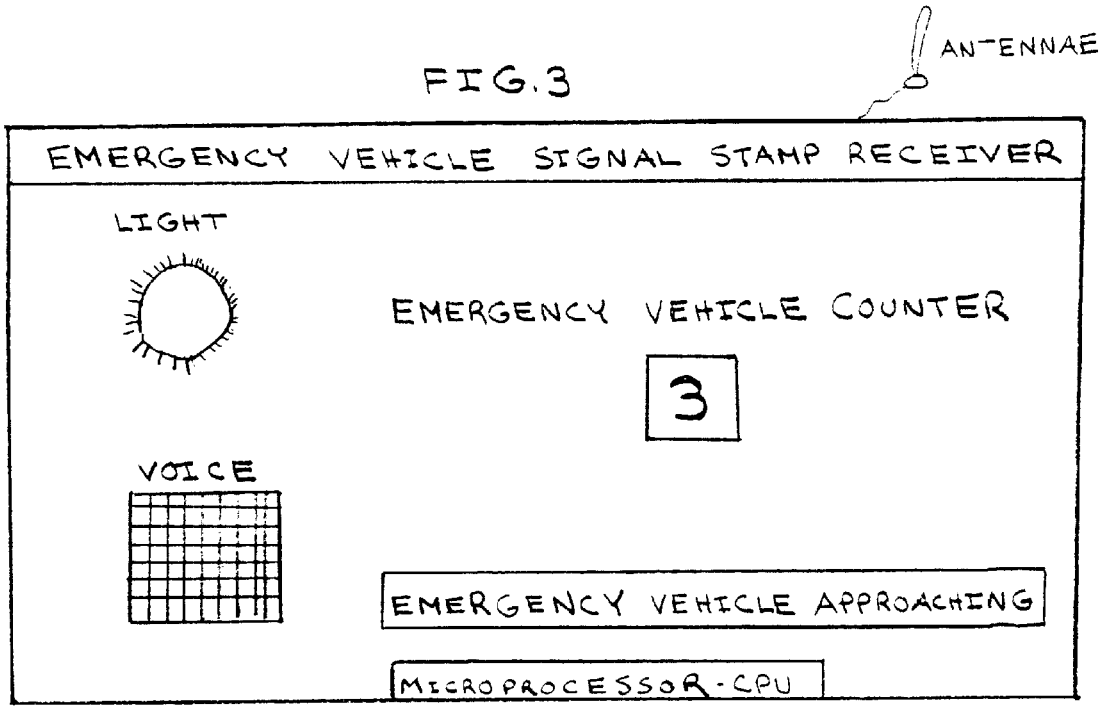
FIG. 3 shows a front view of an emergency vehicle signal stamp receiver.
Figure 5:
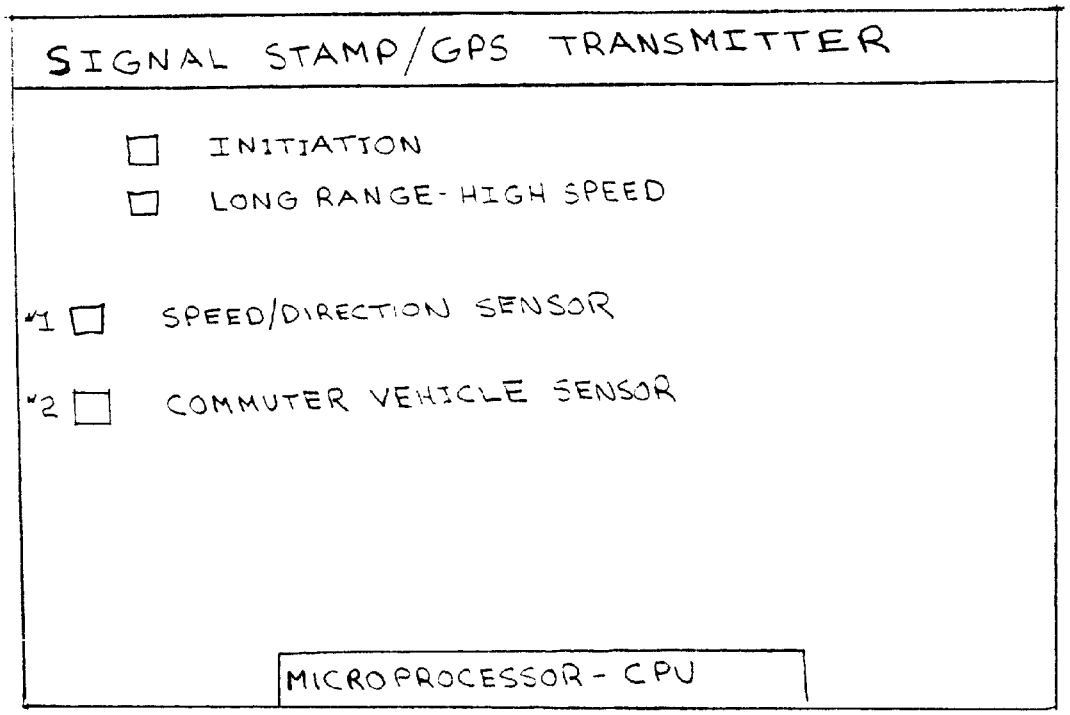
FIG. 5 shows a front view of an emergency vehicle signal stamp and GPS transmitter for the emergency vehicle.
Figure 4A:
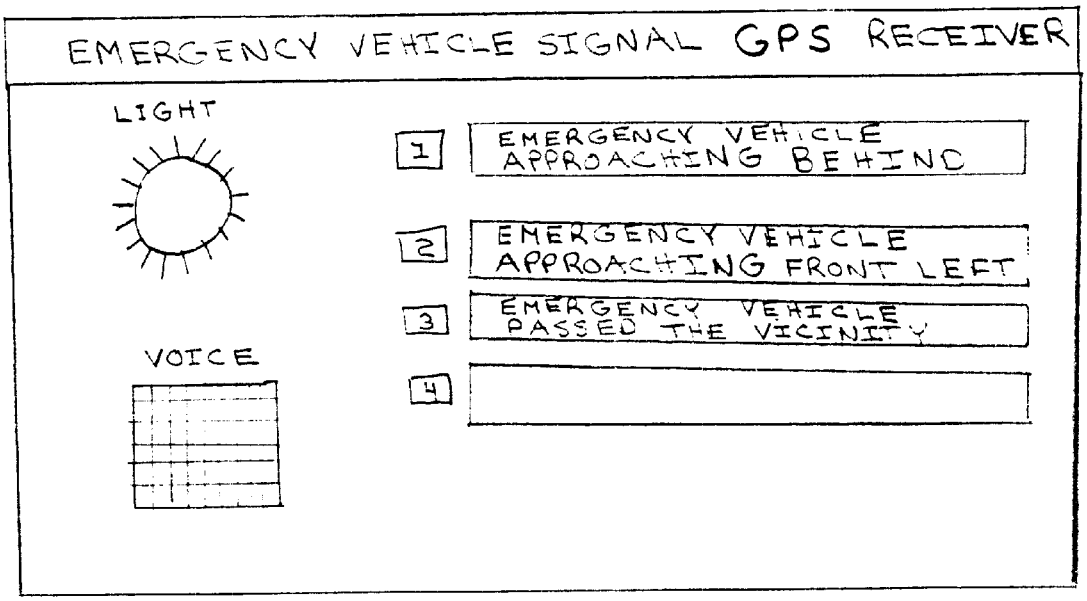
FIG. 4*a* and 4*b* show alternate front views of a GPS signal receiver.
Figure 4B:
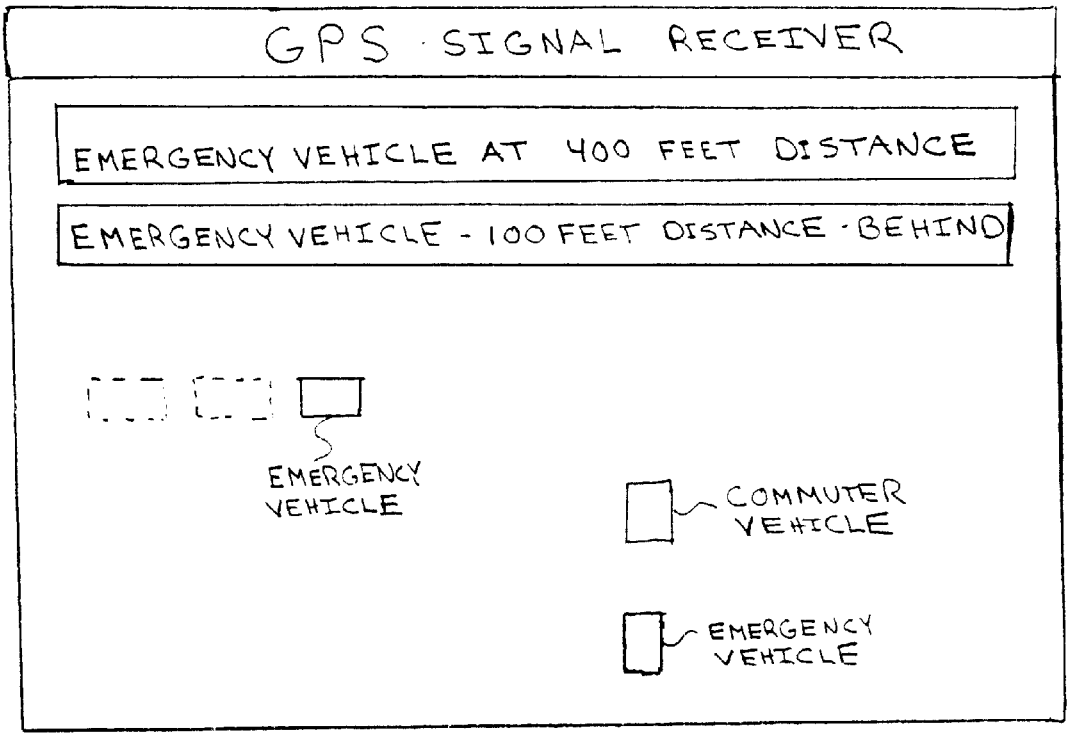

A method for an emergency vehicle alert system for transmitting signals from one or more emergency vehicles to a nearby commuter vehicle includes a combination of steps. The emergency vehicle alert system (EVAS) is energized by activating an initiation switch in one or more of the emergency vehicles. The emergency vehicle driver can turn on the EVAS whenever high-speed travel is required to quickly reach an accident scene. A transmitter located in each of the emergency vehicles, transmits a uniquely individual signal stamp of a predefined frequency. Each emergency vehicle can be identified by the uniquely individual signal stamp. Other emergency vehicles and commuter vehicles in the area with the appropriate receiver can detect the transmitted signal stamp.

The receiver in the commuter vehicle receives the predefined frequency signal stamp. The receiver actuates a notification warning that can be observed by an occupant or driver in the commuter vehicle. Awareness of the emergency vehicle in the vicinity allows the commuter driver to take appropriate evasive action.

The notification warning can be a light, voice recording, alpha-numeric display or other known methods of notification. A combination of notification warnings can be used for more rapid perception by the driver. The voice warning can be selected from an array of digitized voice recordings. Any one of the digitized voice recordings can be selected based on a user's preference. Volume, severity of tone, gender of the voice, and wording of the warning message can all be selected based on the driver's preference. As an additional feature, the voice warning can be recorded by the user in their own voice. Self recording creates a notification warning that elicits a calm and immediate response by the driver.

The receiver indicates the number of emergency vehicles in the vicinity, based on the uniquely individual signal stamp of each emergency vehicle. The receiver informs the driver of the commuter vehicle that one or more emergency vehicles are traveling in the area. A Global Positioning System (GPS) type signal is included with the signal stamp. The GPS signal provides a reference to the location and proximity of each of the nearby emergency vehicles. Gradually, the emergency vehicles travel beyond the range that their transmitters will convey a signal to the commuter vehicles. The receiver then loses the signal stamp of a particular emergency vehicle, correspondingly the receiver indicates one less emergency vehicle in the immediate vicinity. The receiver counts down the emergency vehicles as they travel beyond the transmitting range of each of the transmitters.

Eventually, the receiver is no longer detecting a signal stamp from any of the emergency vehicles. The receiver then indicates an all-clear notification, when the receiver has counted down to zero. The commuter is then confident that all emergency vehicles have departed from the immediate vicinity. Then, the commuter vehicle can safely resume travel.

The signal stamp is most effective and safe when transmitted to commuter vehicles in the forward direction that the emergency vehicle is traveling. Transmitting the signal stamp in a 360 degree full circle, causes the receiver to continue detecting the signal stamp after the emergency vehicle has actually passed by. To overcome this disadvantage the transmitter emits a forward biased signal stamp. The signal stamp has a substantially 180 degree eliptical shaped transmission area. The signal stamp is transmitted only to the commuter vehicles in front of or to the side of the emergency vehicle. The receiver ceases detection of the signal stamp, immediately after the emergency vehicle passes the commuter vehicle. There is no delayed time period where the signal stamp continues to be received, after the emergency vehicle has safely past.

Furthermore, quickly ceasing reception of each signal stamp allows the driver to focus his/her attention on the remaining emergency vehicles that are detected by the receiver. The emergency vehicle emits the Global Positioning System (GPS) signal simultaneously with the notification-warning signal. The GPS component of the signal is detected by the receiver, which indicates the approximate position of the emergency vehicles in relation to the commuter vehicle. The commuter vehicle has a GPS position indicator screen that displays the position of the emergency vehicle in relation to the commuter vehicle. Often, a monitor screen is used to visually display the emergency vehicles. Perceiving numerous emergency vehicles on the monitor screen can require concentration and focus by the driver. The driver's task is easier when passing emergency vehicles are rapidly dropped from the monitor screen and attention can be focused on just the remaining display. The monitor screen can be incorporated into the receiver or can be a separate device.

A microprocessor circuit can be used in both the receiver and the transmitter. The microprocessor circuit is compact and inexpensive to manufacture in large quantities. Microprocessor circuitry is easy to program. Many basic existing types of microprocessor circuits are available in both the GPS design and the signal transmitting design. The specific inventive features of the EVAS can be added to currently available basic microprocessor circuits. The receiver can be connected to the antennae of the commuter vehicle or have an individual antennae. The EVAS is universal and is applicable to both production line vehicles and retrofitting of existing commuter vehicles.

The transmitter can include a first sensor that registers data on the speed and direction of the emergency vehicle. The first sensor can be integral to the transmitter or a separately linked device. The microprocessor circuit of the transmitter includes an algorithm that calculates the strength and speed of the signal, based on the speed of the emergency vehicle. Additionally, the transmitter can have a second sensor that registers the approximate speed of the nearby commuter vehicles. The microprocessor circuit further refines and modifies the strength and speed of the signal, based on the speed of the commuter vehicle.

Additionally, the EVAS can include a long-range high-speed setting on the transmitter that is manually selectable by the driver. The high-speed setting is especially applicable to police vehicles involved in high-speed pursuits on the highway. The high-speed setting can be initiated as part of the step of activating an initiation switch. Vehicles equipped with receivers can be forewarned of a high-speed pursuit in the immediate area. The high-speed setting will provide a warning sooner, rather than relying solely on the sound of a siren for a warning. The extra warning time will allow drivers to pull safely to the side of the road. Many lives are lost each year in high-speed police pursuits. The long-range high-speed setting is a valuable addition to the EVAS, which can save many lives.

The signal stamp includes the additional component of a GPS signal with a predefined frequency, which is transmitted from the emergency vehicle and received by the receiver in the commuter vehicle. The receiver within the commuter vehicle indicates the position of the emergency vehicle in relation to the commuter vehicle, based on the GPS signal. The receiver continuously updates the changing position of the emergency vehicle in relation to the commuter vehicle, based on the changing GPS signal. The occupant can monitor the position of the approaching emergency vehicle, so that the occupant can perform appropriate evasive actions to avoid the emergency vehicle.

Important information is garnered by knowing whether the emergency vehicle is approaching from behind in the same direction of travel, approaching from the front in the opposite lanes of travel, or from the side as cross traffic. A commuter vehicle must quickly clear the lanes of travel, particularly when the emergency vehicle is approaching from behind in the same direction of travel. Occasionally, clearing of the lane may be required when the emergency vehicle is approaching from the front, if the opposite lanes of travel are blocked. In contrast, simply stopping in the travel lane may be the most appropriate when the commuter knows that an emergency vehicle is approaching from the side as cross traffic. Just stopping, rather than pulling over to the side, is appropriate when the commuter is about to enter the same intersection as the cross-opposing emergency vehicle. Adjacent commuter vehicles may be preventing the driver from immediately pulling over, without traveling through the intersection. Thus, the unique signal stamp of each emergency vehicle, together with the GPS component, provides essential data to a driver that allows appropriate safety maneuvers to be promptly taken.

The signal can be a radio frequency signal. The radio frequency signal transmits well over short distances. The distance the signal is transmitted can be adjusted manually at the transmitter. When activated, the first and second speed sensors and the algorithm within the transmitter will further adjust the transmission distance from the initial manual setting. The best transmission distance will vary, in relation to the speed of all participating vehicles. In slower city traffic, less than about 500 feet can provide sufficient warning to commuter vehicles, while not notifying commuters in an excessively large geographical area that lies outside of the intended travel route of the emergency vehicle.

The EVAS is most advantageous when used in one or more emergency first vehicles, which transmit a signal to nearby commuter second vehicles. Emergency first vehicles can include police cars, fire trucks, and ambulances. The EVAS can be used for any type of vehicle, where one or more first vehicles transmit a signal to a receiver in a second vehicle.

The advantageous of the EVAS are numerable. First, the EVAS can transmit the signal a general distance range based on the speed of travel. Unlike sirens, where only the volume can be adjusted to increase the distance projection. Second, all of the cost of the system is not absorbed by the municipal governments. Third, an indication is provided of how many emergency vehicles are in the area. Fourth, the first and second speed sensors and the algorithm within the transmitter will further adjust the transmission distance of the signals from the initial manual setting. Fifth, the EVAS can be implemented on a nationwide basis, which provides uniformity of components and transmission frequency. Additionally, the GPS shows the position of the emergency vehicles in relation to the commuter vehicles.

Preferred embodiments of the invention have been described in considerable detail. Other variations are possible, therefore the scope of the invention shall not be limited by the description above and the appended claims.

What is claimed is:

1. A method for an emergency vehicle alert system for transmitting signals from one or more emergency first vehicles to a nearby commuter second vehicle, comprising the steps of:

a) activating an initiation switch in one or more of the emergency first vehicles;

b) transmitting a uniquely individual signal stamp of a predefined frequency from a transmitter in each of the emergency first vehicles;

c) receiving each of the predefined frequency signal stamps by a receiver in the commuter second vehicle;

d) actuating by the receiver of a notification warning, for observation by an occupant in the commuter second vehicle;

e) indicating by the receiver the number of emergency first vehicles in the vicinity, based on the uniquely individual signal of each emergency first vehicle; and f) counting down by the receiver the number of emergency first vehicles in the vicinity, as the emergency first vehicles travel beyond the transmitting range of each of the transmitters.

2. The method of claim 1, further comprising the steps of:

a) transmitting a GPS signal of a predefined frequency from the emergency first vehicle, upon transmitting the uniquely individual signal stamp;

b) receiving the GPS signal of the predefined frequency signal by the receiver in the commuter second vehicle;

c) indicating within the commuter second vehicle the position of the emergency first vehicle in relation to the commuter second vehicle, based on the GPS signal; and d) updating continuously the position of the emergency first vehicle in relation to the commuter second vehicle, based on the GPS signal, such that the occupant can perform appropriate actions to avoid the emergency first vehicle.

3. The method of claim 2, further comprising the step of sensing by a first sensor, and registering by a first sensor data on the speed and direction of the emergency first vehicle, wherein the first sensor sends the data to the transmitter, wherein the transmitter, having an algorithm that calculates the strength and approximate transmission distance of the signal, based on the speed of the emergency first vehicle; upon transmitting a GPS signal.

4. The method of claim 3, further including the step of: indicating an all clear notification, when all emergency first vehicles have traveled beyond the transmitting range of each of the transmitters, upon counting down by the receiver.

5. The method of claim 4, further including the step of emitting from the transmitter a forward biased signal stamp having a substantially 180 degrees eliptical shaped transmission area, upon transmitting of the signal stamp.

6. The method of claim 5, wherein the notification warning is a voice recording.

7. The method of claim 6, wherein the warning is selected from a plurality of digitized voice recordings, wherein any one of the digitized voice recordings can be selected based on a user's preference.

8. The method of claim 5, wherein the warning is a light.

9. The method of claim 5, wherein the warning is an alpha-numeric display.

10. The method of claim 6, wherein the receiver having a microprocessor circuit.

11. The method of claim 10, wherein the transmitter having a microprocessor circuit.

12. The method of claim 11, wherein the distance the signal is transmitted is less than 500 feet.

13. The method of claim 12, wherein the signal is a radio frequency signal.

14. The method of claim 2, further including the step of: indicating an all clear notification, when all emergency first vehicles have traveled beyond the transmitting range of each of the GPS signals, upon updating continuously the position of the emergency first vehicle.

15. The method of claim 14, further including the step of emitting from the GPS transmitter a forward biased GPS signal having a substantially 180 degrees eliptical shaped transmission area, upon transmitting of the signal stamp.

16. The method of claim 15, wherein activating the initiation switch in the one or more emergency first vehicles further comprises the step of: selecting a long-range high-speed setting on the transmitter.

* * * * *